US007258815B2

(12) United States Patent
Drenker et al.

(10) Patent No.: US 7,258,815 B2
(45) Date of Patent: Aug. 21, 2007

(54) USE OF BRIGHTENERS FOR THE PREPARATION OF COATING SLIPS

(76) Inventors: Karl-Heinz Drenker, Mittelgönrather Str. 56, 42655 Solingen (DE); Heinz Giesecke, Am Alten Hof 28, 51519 Odenthal (DE); Bernhard Hunke, Juckenbacher Str. 17a, 53783 Eitorf (DE); Bernd Hauschel, Walter-Flex-Str. 30, 51373 Leverkusen (DE); Reiner Gottschalk, Andreas-Gryohius-Str. 3, 51065 Köln (DE); Claudia Hundertmark, Paffendorfer Weg 23, 50126 Bergheim (DE)

( * ) Notice: Subject to any disclaimer, the term of this patent is extended or adjusted under 35 U.S.C. 154(b) by 0 days.

(21) Appl. No.: 10/417,041

(22) Filed: Apr. 16, 2003

(65) Prior Publication Data

US 2003/0236326 A1 Dec. 25, 2003

(30) Foreign Application Priority Data

Apr. 19, 2002 (DE) ..... 102 17 677

(51) Int. Cl.
*D21H 21/30* (2006.01)

(52) U.S. Cl. ..... 252/301.35; 252/301.21; 252/301.22; 252/301.26; 427/158; 162/135; 162/158; 162/162; 162/169; 162/168.1; 524/503; 524/523; 524/524; 524/502

(58) Field of Classification Search ..... 252/301.35, 252/301.21, 301.22, 301.26; 427/158; 162/135, 162/158, 162, 169, 168.1; 524/503, 523, 524/524, 502
See application file for complete search history.

(56) References Cited

U.S. PATENT DOCUMENTS

| | | | | |
|---|---|---|---|---|
| 4,405,751 | A | 9/1983 | Muller et al. | |
| 4,717,502 | A * | 1/1988 | Schmid | 252/301.23 |
| 5,976,410 | A | 11/1999 | Rohringer et al. | 252/301 |
| 6,025,490 | A | 2/2000 | Feldhues et al. | 544/193.2 |
| 6,165,973 | A | 12/2000 | Baker | 510/516 |
| 6,426,381 | B1 | 7/2002 | Koenig et al. | 524/724 |
| 2001/0009938 | A1 | 7/2001 | Eckstein et al. | |

FOREIGN PATENT DOCUMENTS

| | | |
|---|---|---|
| GB | 896533 | 5/1962 |
| GB | 1391593 | 4/1975 |
| WO | WO98/42865 | 10/1998 |
| WO | WO 01/11140 A1 | 2/2001 |
| WO | 02/097193 | 12/2002 |

OTHER PUBLICATIONS

Delivery Note Leucophor LCP (German-to-English Translation); Dec. 7, 2000; 1 page.

Opposition Document (German-to-English Translation); European Patent No. 1 355 004 B1; Dec. 19, 2006; 6 pages.

* cited by examiner

*Primary Examiner*—C. Melissa Koslow
(74) *Attorney, Agent, or Firm*—Cantor Colburn LLP

(57) ABSTRACT

The use of optical brighteners of the formula (II):

(II)

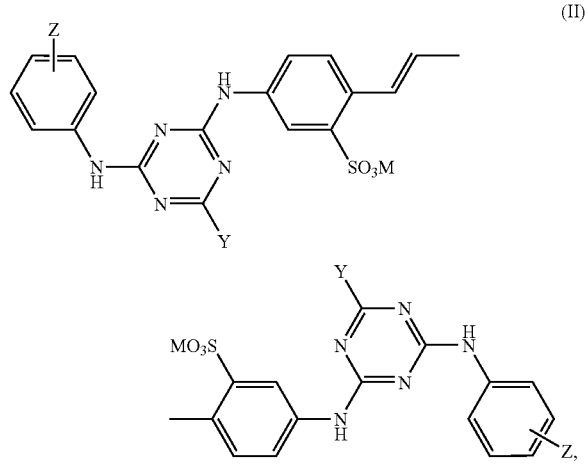

in which
Y denotes a radical of the formula (III)

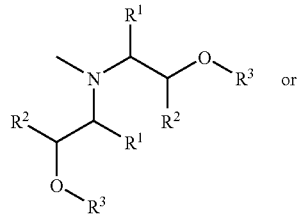

or (IV)

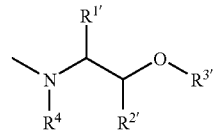

and the other substituents have the meaning stated in the description, for brightening aqueous coating slips comprising at least one latex binder and at least one synthetic co-binder differing therefrom.

19 Claims, No Drawings

USE OF BRIGHTENERS FOR THE PREPARATION OF COATING SLIPS

BACKGROUND

The invention relates to the use of special brighteners for preparing coating slips, coating slips per se and their use for the production of brightened papers.

Optical brighteners are used mainly for brightening paper or textiles or as an additive to detergents. The brightening of uncoated papers or untreated coating papers can be effected by beater use and/or surface application of optical brighteners, which are usually present for this purpose in dissolved form. In the production of coated papers, the addition of optical brighteners to the coating slip is customary, so that, in the finished coated paper, the optical brightener is also present in the pigment layer applied to the paper. Coated papers are particularly suitable for the production of high-quality prints. In addition to good printability properties, their quality is therefore assessed mainly according to optical properties, such as gloss and whiteness. There is a progressive trend toward coated papers having high whitenesses and therefore the desire for optical brighteners which are as effective as possible as coating slip components.

The most customary and most widely used paper brighteners are those of the formula (I)

(I)

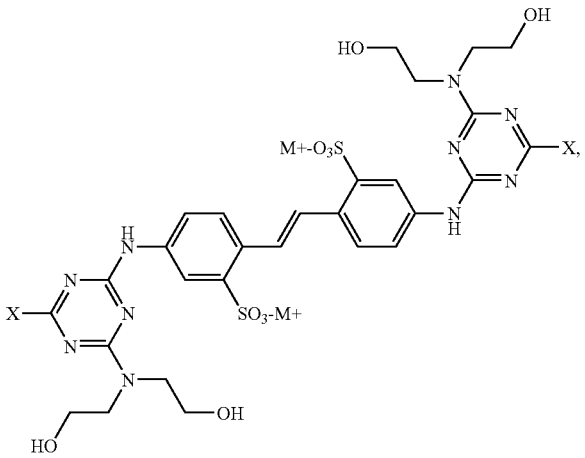

in which

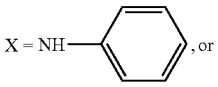

(disulfo type)

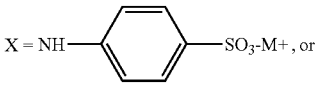

(tetrasulfo type)

-continued

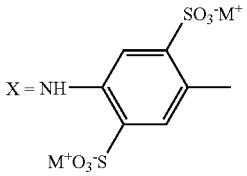

(hexasulfo type)

M represents Na, K or optionally substituted ammonium.

If the use of the so-called tetrasulfo type and hexasulfo type shown in formula (I) in paper coating is compared, saturation behavior with respect to the CIE whiteness is found above certain added amounts of brightener of the tetrasulfo type. In other words, when larger amounts are used, no further increase in whiteness is found and there may even be adverse effects on the CIE whiteness. This saturation behavior occurs with the use of the hexasulfo type as a rule only when substantially larger amounts are used compared with the tetrasulfo type. Consequently, higher whitenesses can generally be realized with hexasulfoflavonate brighteners than with tetrasulfoflavonate brighteners. The effect of saturation is also referred to as greening. The greening level, e.g., the point above which the use of increasing amounts of brightener result in virtually no further increase in whiteness, can be derived, for example, from the a*-b* diagram, a* and b* being the color coordinates in the CIE Lab system.

Since the greening in the case of hexasulfo types occurs only when relatively large amounts are used, the hexasulfoflavonate brightener shown in formula (I) and also other hexasulfoflavonate brighteners are particularly suitable for the production of coated, highly white paper. The exact application amounts at which the greening occurs in the case of tetra- and hexasulfoflavonate brighteners depend on the composition of the respective coating slip, inter alia on its carrier content.

On recycling coated papers, for example, for reuse of coated waste in the paper mill, the coated paper is beaten again, the brightener not fixed to the fibers initially going into solution from the coat and partly coating paper fibers. The increased solubility of the hexasulfoflavonate brighteners is disadvantageous in this context, since brightener not fixed to fibers acts as an interfering anionic substance in the circulation water of the paper machine and reduces the effect of cationic paper chemicals, such as retention aids or engine sizes, resulting in additional consumption of these paper chemicals.

There is therefore the desire for improved optical brighteners for brightening coating slips, in particular coating slips, with which higher whitenesses can be realized than with the use of customary di- and tetrasulfo types, such as those shown in formula (I), but which lead to a lower load of interfering substances in the circulation water of the paper machine than hexasulfo types on recycling of coated papers.

The brightening of coating slips based on synthetic co-binders is of primary importance. Natural co-binders, in particular starch, are not very suitable for top coats or single coats, owing to their swelling behavior on contact with aqueous liquids. As a result of the swelling, the quality of the printed image is reduced when printing on the coated paper. Starch is therefore preferably used as a co-binder in preliminary coats in the case of multiply coated papers, whereas synthetic co-binders are preferred in the case of singly coated papers or top coats. In the case of single coats or top coats, the whiteness requirements are generally higher than in the case of preliminary coats.

EP-A 192 600 states that certain polyethylene glycol-containing brightener formulations are particularly suitable as coating slip additives. However, only latex binders in combination with natural co-binders are used explicitly for coating slips.

Surprisingly, it has now been found that a certain class of bistriazinylflavonate brighteners having 2 or 4 sulfo groups meet these requirements in an outstanding manner in coating slip systems which contain synthetic co-binders.

SUMMARY

The invention relates to a method for brightening an aqueous coating slip that contains at least one latex binder and at least one synthetic co-binder different therefrom comprising treating the coating slip with an optical brightener of the formula (II):

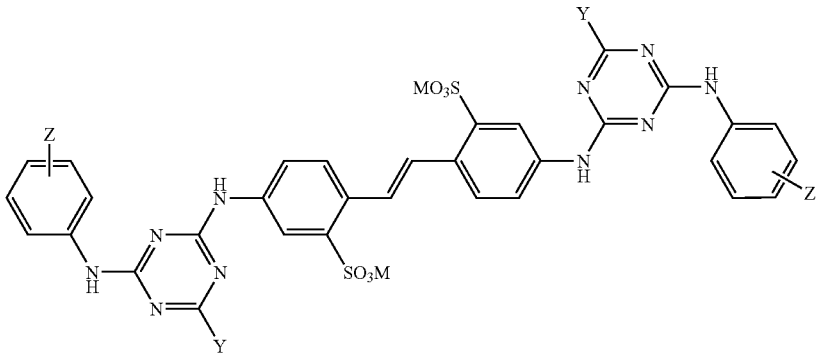

in which

Y denotes a radical of the formula (III)

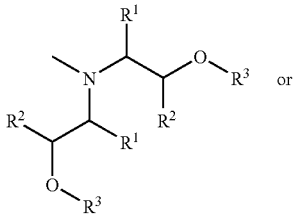

or (IV)

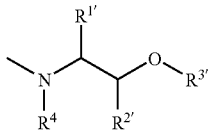

and $R^1$ represents $C_1$-$C_6$-alkyl and $R^2$ represents H, or $R^1$ represents H and $R^2$ represents $C_1$-$C_6$-alkyl and, independently thereof, $R^3$ represents H, methyl, ethyl, $CH_2CH_2OH$ or $CH_2CH_2OCH_3$, $R^{1'}$ represents $C_1$-$C_6$-alkyl and $R^{2'}$ represents H, or $R^{1'}$ represents H and $R^{2'}$ represents $C_1$-$C_6$-alkyl and, independently thereof, $R^{3'}$ represents H, methyl, ethyl, $CH_2CH_2OH$ or $CH_2CH_2OCH_3$ and $R^4$ represents $C_1$-$C_4$-alkyl, Z denotes H or $SO_3M$, it being possible for the sulfo groups to be in the o-, m- or p-position, and M denotes H or one equivalent of a cation selected from the group consisting of Li, Na, K, Ca, Mg, ammonium and ammonium which is mono-, di-, tri- or tetrasubstituted by the radicals $C_1$-$C_4$-alkyl or $C_2$-$C_4$-hydroxyalkyl, and thereby brightening the latex binder. The latex binder has at least one synthetic co-binder that differs from the latex binder.

In another embodiment, the invention relates to a coating slip comprising:

(a) at least one white pigment, (b) at least one latex binder, (c) at least one synthetic co-binder differing therefrom and (d) at least one brightener of the formula (II).

In another embodiment, the invention relates to a method for making a coated paper comprising applying to a paper substrate a coating slip comprising (a) at least one white pigment, (b) at least one latex binder, (c) at least one synthetic co-binder differing therefrom and (d) at least one brightener of the formula (II), and thereby making the coated paper.

These and other features, aspects, and advantages of the present invention will become better understood with reference to the following description and appended claims.

DESCRIPTION

The invention therefore relates to the use of optical brighteners of the formula (II):

(II)

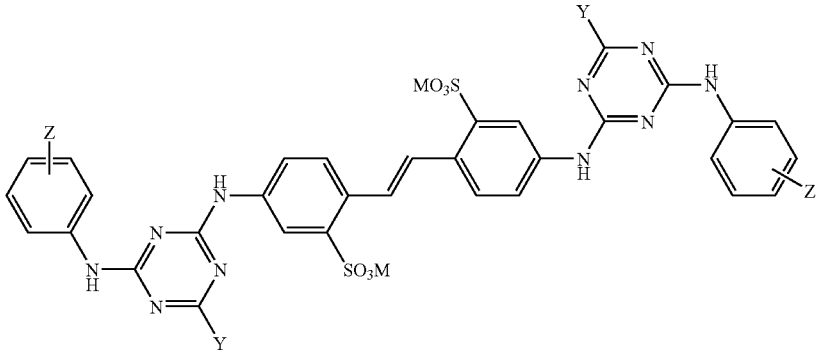

in which

Y denotes a radical of the formula (III)

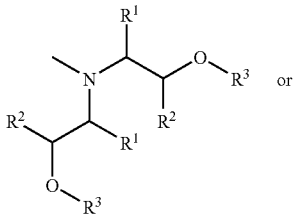

or (IV)

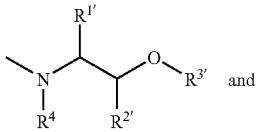

and $R^1$ represents $C_1$-$C_6$-alkyl and $R^2$ represents H, or $R^1$ represents H and $R^2$ represents $C_1$-$C_6$-alkyl, and, independently thereof, $R^3$ represents H, methyl, ethyl, $CH_2CH_2OH$ or $CH_2CH_2OCH_3$, $R^{1'}$ represents $C_1$-$C_6$-alkyl and $R^{2'}$ represents H, or $R^{1'}$ represents H and $R^{2'}$ represents $C_1$-$C_6$-alkyl, and, independently thereof, $R^{3'}$ represents H, methyl, ethyl, $CH_2CH_2OH$ or $CH_2CH_2OCH_3$ and $R^4$ represents $C_1$-$C_4$-alkyl, Z denotes H or $SO_3M$, it being possible for the sulfo groups to be in the o-, m- or p-position, and M denotes H or one equivalent of a cation selected from the group consisting of Li, Na, K, Ca, Mg, ammonium or ammonium which is mono-, di-, tri- or tetrasubstituted by the radicals $C_1$-$C_4$-alkyl or $C_2$-$C_4$-hydroxyalkyl for brightening aqueous coating slips containing at least one latex binder and at least one synthetic co-binder differing therefrom.

In a preferred embodiment, the synthetic co-binder is not a latex binder. Regarding the brightener of the formula (II), mixtures of said possibilities for M are also suitable. Preferred optical brighteners are those of the formula (II) where $R^1$ is H, $R^2$ is linear $C_1$-$C_6$-alkyl and $R^3$ is H.

Further preferred optical brighteners are those of the formula (II) where $R^{1'}$ is H, $R^{2'}$ is a linear $C_1$-$C_6$-alkyl and $R^{3'}$ is H and $R^4$ is H or methyl.

Particularly preferred is the use of the optical brightener of the formula (IIa):

(IIa)

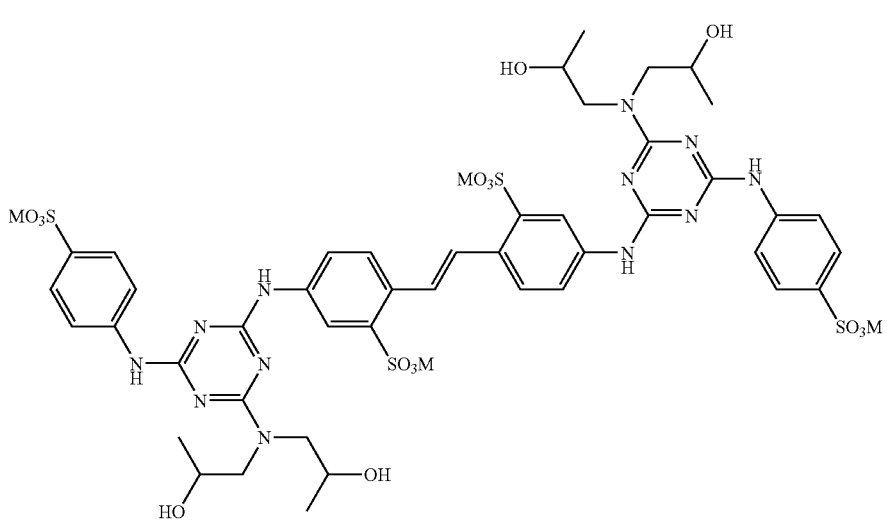

in which

M has the above-mentioned meaning.

The particularly preferred brighteners of the formula (IIa) and related structures are known per se. Thus, GB-A 896 533 describes the preparation of this brightener and the use in beater and size press applications for brightening paper.

The brighteners used according to the invention may be used in the form of an aqueous solution which substantially contains dissolved brightener salts, water and optionally standardizing agents. Furthermore, they can be used as aqueous carrier-containing formulations which substantially contain dissolved brightener salts, water and carrier substances.

It is also possible to use the brighteners used according to the invention in the solid form, for example as powder or granules. It is advantageous if the brighteners go into solution before application of the coating slip. The dissolution process of the brighteners can be combined with preparation of the coating slip and powders or granules are used.

The brighteners used according to the invention are prepared by known methods, as described, for example, in GB-A 896 533 or in EP-A 860 437, for example from about 2 mol of cyanuric chloride, about 1 mol of 4,4'-diaminostilbene-2,2'-disulfonic acid or of a corresponding salt, about 2 mol of aniline, sulfanilic acid or a corresponding salt and about 2-2.5 mol of the amines corresponding to the substituent Y. After the end of the reaction, the crude solution in the corresponding brightener can be desalinated, for example by suitable membrane separation methods, and concentrated, as described, for example, in EP-A-992 547. Preferred membrane separation methods are ultrafiltration, diffusion dialysis and electrodialysis. However, it is also possible to isolate the resulting brightener as a solid, for example by salting out or acid addition and precipitation as a dye acid. The solid formed can then be isolated, for example, on a filter press and optionally further purified by washing.

For the preparation of the brightener preparation suitable for use, the brightener can also be isolated from solution in the form of a powder, for example by spray drying, further additives, such as dispersants, dedusting agents, etc. optionally being added before the drying.

Aqueous preparations can be prepared from crude solutions, from concentrated and desalinated solutions or from water-containing press cakes. To build up particularly good whiteness, it is advantageous to incorporate so-called carrier substances into the aqueous brightener preparations.

The aqueous brightener preparations preferably contain a) from about 10 to about 40% by weight of at least one brightener of the formula (II), b) from 0 to about 30% by weight of standardizing agent, c) from 0 to about 2% by weight of inorganic salts and d) from about 23 to about 90% by weight of water, the sum of the components a) to d) being from about 95 to 100% by weight, based on the preparation.

Customary standardizing agents are, for example, urea, diethylene glycol, triethylene glycol, propanediol, glycerol, ε-caprolactam, ethanolamine, diethanolamine and triethanolamine. In each case, preparations free of standardizing agents are preferred.

The aqueous brightener preparations preferably likewise contain:

a) from about 5 to about 40% by weight of at least one brightener of the formula (II), b) from about 1 to about 50% by weight of at least one carrier substance, c) from 0 to about 2% by weight of inorganic salts and d) from about 3 to about 94% by weight of water, the sum of the components a) to d) being from about 95 to 100% by weight, based on the preparation.

Suitable carrier substances are in general hydrophilic polymers having the ability to form hydrogen bridge bonds. Preferred carrier substances are polyvinyl alcohols, carboxymethylcelluloses and polyethylene glycols having a number average molecular weight of from about 200 to about 8,000 g/mol, as well as any desired mixtures of these substances, it being possible for these polymers optionally to be modified. Preferred polyvinyl alcohols are those having a degree of hydrolysis of >85%, and preferred carboxymethylcellulose are those having a degree of substitution DS of >0.5. Polyethylene glycols having a number average molecular weight Mn of from about 200 to about about 8,000 g/mol are particularly preferred.

For example, natural, derivatized or degraded starches, alginates, casein, proteins, polyacrylamides, polyacrylic acids, hydroxyalkylcellulose and polyvinylpyrrolidone are furthermore suitable.

Independently of the carrier content of the coating slip, as a rule more advantageous whiteness build-up curves are realized with such formulations than with carrier-free brightener preparations.

In addition, the carrier-free as well as carrier-containing preparations may contain small amounts, usually amounts of less than about 5% by weight, of further auxiliaries, such as dispersants, thickeners, antifreezes, preservatives, complexing agents, etc., or organic byproducts from the brightener synthesis which were not completely removed during the working up.

The carrier-containing preparations may additionally contain standardizing agents for increasing the solubility and shelf life.

The carrier-free aqueous brightener preparations are prepared in general by adjusting a brightener solution (crude or membrane-filter) with a base to a neutral to weakly alkaline pH, optionally adding and dissolving one or more standardizing agents and optionally diluting with water to the desired final concentration. If the brightener is used in the form of a water-moist press cake, a certain amount of press cake is completely dissolved in water with addition of base and with stirring and optionally at elevated temperatures, and optionally adjusted to the desired concentration by further addition of water.

Preferred bases for this purpose are alkali metal hydroxides, demineralized water being preferred for dilution. The pH established is in the range from about 7 to about 11, preferably from about 8 to about 10. Temperatures of from about 25 to about 80° C. are customary for the dissolution.

The carrier-containing preparations are prepared in general in an analogous manner, the carrier substance also being added at any desired time during the preparation process. If the carrier substance is added in solid form, it is generally completely dissolved with stirring and optionally at elevated temperatures, so that a homogeneous liquid preparation forms. The viscosity of the carrier-containing preparations at room temperature is preferably less than about 3,000 mPas. The customary dissolution temperature is in the range from about 25 to about 100° C.

Concentrated, aqueous brightener preparations are usually characterized by the so-called E1/1 value. For this purpose, the extinction of a highly dilute solution of the preparation is determined by the customary UV/V is spectroscopy methods known to a person skilled in the art, in a 1 cm cell at a certain wavelength. This wavelength corresponds to the long-wave absorption maximum of the respective brightener molecule. In the case of flavonate brighteners, it is about 350 nm. The E1/1 value then corresponds to the imaginary extinction value estimated for a 1% strength solution.

The E1/1 values of the brightener preparations used according to the invention are preferably from about 50 to about 180, particularly preferably from about 70 to about 140.

The coating slips to be brightened according to the invention contain, as latex binder, for example latices based on styrene/butadiene, styrene/acrylate or vinyl acetate. These polymers can optionally be modified by further monomers, such as acrylonitrile, acrylamide, α,β-unsaturated carboxylic acids, such as acrylic acid, methacrylic acid, itaconic acid or maleic acid, acrylates, vinyl esters, ethylene, vinyl chloride, vinylidene chloride, etc. In general, however, all customary latex binders which are used for the preparation of paper coating slips are suitable. The coating slips contain, as synthetic co-binders differing from these, for example, carboxymethylcellulose, hydroxyalkylcellulose and/or polyvinyl alcohol and acrylate-based synthetic thickeners.

Preferred latex binders are those based on styrene/butadiene. Preferred synthetic co-binders are polyvinyl alcohols, in particular those having a degree of hydrolysis of >85%, and in particular a Brookfield viscosity of 2-80 mPas (measured on a 4% strength aqueous solution at 20° C.), carboxymethylcelluloses, in particular those having a degree of substitution of >0.5, and in particular a Brookfield viscosity of from about 5 to about 5000 mPas (measured on a 2% strength aqueous solution at 25° C.) and mixtures of these two substances.

The coating slips to be brightened according to the invention preferably furthermore contain white pigments.

Customarily used white pigments are calcium carbonate in natural or precipitated form, kaolin, talc, titanium dioxide, satin white, aluminum hydroxide and barium sulfate, often also in the form of mixtures.

First, dispersants may be mentioned as optional further ingredients of the coating slips to be brightened according to the invention. Polyacrylates, polyphosphates and Na citrate are customary here. In principle, polyaspartic acid is also suitable. Further possible additives are crosslinking agents. Examples of these are urea/formaldehyde resins, melamine/formaldehyde resins, glyoxal and ammonium/zirconium carbonate. In principle, wet strength agents based on polyamidoamine/epichlorohydrin resins, glyoxalated polyacrylamides or hydrophilized polyisocyanates, as described, for example, in EP-A-825 181, are also suitable as crosslinking agents. Finally, antifoams, biocides, complexing agents, bases for pH adjustment, Ca stearate, optical brighteners other than those of the formula (II) and shading dyes may be mentioned as further possible additives. Sometimes surface sizes are also added for imparting water repellency to the coating slip. Examples of these are polymer solutions based on styrene/acrylic acid, styrene/maleic anhydride or oligourethanes, and polymer dispersions based on acrylonitrile/acrylate or styrene/acrylate. The latter are described, for example in WO-A-99/42490.

The coating slips according to the invention which are to be brightened contain the latex binder preferably in an amount of from about 3 to about 20% by weight and the synthetic co-binder in an amount of from about 0.1 to about 3% by weight, based in each case on the white pigment of the coating slip.

The invention furthermore relates to an aqueous coating slip, e.g., an aqueous pigment preparation, comprising at least one white pigment, at least one latex binder, at least one synthetic co-binder differing therefrom and at least one brightener of the formula (II).

Preferably, the amount of latex binder (calculated as dry substance) is from about 3 to about 20% by weight, in particular from about 5 to about 15% by weight, independently thereof the amount of co-binder is from about 0.1 to about 3% by weight, in particular from about 0.5 to about 1.5% by weight, and likewise independently thereof the amount of brightener of the formula (II) is from about 0.025 to about 1% by weight, based in each case on the amount of white pigment.

The preferred embodiments for white pigment, latex binder, co-binder, brightener and other additives, as described above, are applicable.

The coating slip preferably additionally contains at least one dispersant, in particular in an amount of from about 0.05 to about 1% by weight, based on the white pigment in the coating slip. Suitable dispersants are preferably polyacrylic acid and corresponding salts. The water content of the coating slip is preferably from about 30 to about 50% by weight, based on the total amount of coating slip.

The invention furthermore relates to the use of the coating slips according to the invention for the production of coated papers.

The coating slips can preferably be applied to the paper once or several times by all application methods suitable for this purpose, such as by knife coating in various embodiments, air brush, blade, roll-coater, film press, casting methods, etc. The immobilization and drying of the coating slip is usually effected initially by contactless hot-air and/or IR drying, followed as a rule by contact drying by means of heated rolls. Calendering for compaction, smoothing or influencing the gloss of the coated paper, for example by means of a calender, is then usually carried out.

Suitable uncoated base papers or untreated coating papers, boards and cardboards are in principle papers, boards and cardboards produced from bleached or unbleached, wood-containing or wood-free, waste paper-containing and deinked fibers. These may furthermore contain mineral fillers, such as natural or precipitated chalk, kaolin, talc or annalines. The uncoated papers, boards and cardboards can be engine sized and/or surface sized, with the result that, inter alia, the penetration and the adhesion of the coating slip are influenced. Customary engine sizes are alkylketene dimers (AKD), alkenylsuccinic anhydride (ASA) and a combination of rosin size and alum, and customary surface sizes are the abovementioned polymer solutions based on styrene/acrylic acid, styrene/maleic anhydride or oligourethanes, and polymer dispersions based on acrylonitrile/acrylate or styrene/acrylate. For controlling the desired whiteness properties of the resulting coated paper, the base papers can be brightened in the beater and/or surface brightened, for which purpose, for example, flavonate brighteners are used.

The invention is further described in the following illustrative examples in which all parts and percentages are by weight unless otherwise indicated.

EXAMPLES

Example 1

77.6 g of a membrane-filtered aqueous concentrate having an E1/1 value of 161 and a pH of 8.5, which contains the brightener of the formula (IIa) in the form of the Na salt, were mixed with 22 g of demineralized water while stirring at room temperature and adjusted to pH 9.0 with about 10% strength sodium hydroxide solution. A carrier-free brightener preparation having an E1/1 value of 125 in the form of a yellow-brownish, homogenous liquid was obtained. This corresponds to a content of (IIa) of about 23% by weight.

Example 2

65.2 g of a membrane-filtered aqueous concentrate having an E1/1 value of 161 and a pH of 8.5, which contained the brightener of the formula (IIa) in the form of the Na salt, were mixed with 31 g of polyethylene glycol 1550 (average molecular weight Mn 1550 g/mol) while stirring at room temperature. For this purpose, the polyethylene glycol 1550 which is waxy at room temperature was heated to about 60° C. before the addition, melted during this procedure and added in the form of hot liquid at about 60° C. 3.5 g of demineralized water were furthermore added and the pH is adjusted to 9.0 with 10% strength sodium hydroxide solution. The preparation was then heated to 50° C. while stirring and stirred for 30 min at this temperature. After cooling to room temperature, a carrier-containing brightener preparation having an E1/1 value of 105 in the form of a yellow-brownish, fluorescent, homogeneous liquid was obtained. This corresponded to a content (IIa) of about 19% by weight.

Example 3

(Not According to the Invention)

The procedure is as in Example 2, but another brightener type was employed and the following amounts were used: 64.8 g of a membrane-filtered aqueous concentrate having an E1/1 value of 162 and a pH of 8.6, which contained the tetrasulfo type brightener of the formula (I) in the form of the Na salt 31 g of polyethylene glycol 1550 4 g of demineralized water.

A carrier-containing brightener preparation having an E1/1 value of 105 and a pH of 9.0 in the form of a yellow-brownish, fluorescent, homogeneous liquid was obtained. This correspondeds to a content of the tetrasulfo type brightener of about 18% by weight.

Example 4

(Not According to the Invention)

The procedure is as in Example 1, but the brightener used was the tetrasulfo type of the formula (I) in the form of the Na salt.

The brightener preparation had an E1/1 value of 125. This corresponded to a brightener content of about 21% by weight.

Use Example 1

A paper coating slip was prepared from the following components:

100 parts of white pigment (chalk/kaolin mixture)

6.5 parts of Baystal P7110 as a binder, calculated as dry substance (styrene/butadiene latex from Polymerlatex GmbH)

1.5 parts of Finnfix 10 as a synthetic co-binder (carboxymethylcellulose from Noviant)

0.25 part of Polysalz® S as a dispersant based on polyacrylic acid (BASF AG)

Water

10% strength sodium hydroxide solution.

The CMC Finnfix 10 used had an active content of 98%. The Brookfield viscosity of a 4% strength solution, measured at 25° C., is 50-200 mPas.

The amount of water and the amount of sodium hydroxide solution were chosen so that a solids content of 57% and a pH of 9.0 result.

The coating slip was divided into 10 parts and 0.4%, 0.8%, 1.2%, 1.6% and 1.8% of the brightener preparation from Example 1 were added to 1 part each and then stirred for 10 min. The amounts added were based on the solids content of the coating slip. For comparison, the same amounts of the brightener preparation from Example 4 were added to 1 part each of the coating slips in the same manner.

The brightened coating slips obtained were applied by means of a laboratory knife coater (from Erichsen, K-Control-Coater, model K 202) to wood-free base papers having a basis weight of about 80 g/m$^2$. The coated papers were dried for 1 min at 95° C. on a drying cylinder and then stored for 3 h at 23° C. and 50% relative humidity. The measurement of the parameters L*, a*, b* and the determination of the CIE whiteness were then carried out using a whiteness meter (Datacolor Elrepho 2000).

The values obtained are listed in Tables 1 and 2.

TABLE 1

Brightener preparation from Example 1 (E1/1 = 125)

| Amount (%) | CIE whiteness | L* | a* | b* |
|---|---|---|---|---|
| 0.4 | 101.80 | 94.12 | 0.81 | −3.60 |
| 0.8 | 108.00 | 94.24 | 1.11 | −4.89 |
| 1.2 | 111.50 | 94.34 | 1.26 | −5.63 |
| 1.6 | 114.50 | 94.42 | 1.34 | −6.25 |
| 1.8 | 116.10 | 94.46 | 1.37 | −6.62 |

TABLE 2

Brightener preparation from Example 4 (E1/1 = 125)

| Amount (%) | CIE whiteness | L* | a* | b* |
|---|---|---|---|---|
| 0.4 | 102.10 | 94.11 | 0.74 | −3.69 |
| 0.8 | 107.70 | 94.33 | 0.97 | −4.81 |
| 1.2 | 110.04 | 94.43 | 0.98 | −5.36 |
| 1.6 | 113.30 | 94.55 | 0.97 | −5.96 |
| 1.8 | 113.50 | 94.60 | 0.90 | −6.04 |

It can be seen that employing the brighteners used according to the invention and having the same E1/1 in each case in the carboxymethylcellulose-containing coating slip led to better CIE whiteness values than the brightener from Example 4. The a*-b* values furthermore showed that greening begins from 1.6% in the case of the tetra type not according to the invention, whereas this was still not detectable up to 1.8% when the brightener according to the invention from Example 1 is used.

Use Example 2

The procedure is as in use Example 1 was practiced, except that a polyvinyl alcohol-containing coating slip of another composition was employed and the carrier-containing brightener preparations from Examples 2 and 3 were used in each case in added amounts of 0.8%, 1.6%, 2.4% and 3.2%, based on the solids content of the coating slip.

Composition of the coating slip:

100 parts of white pigment (chalk/kaolin mixture)

7.5 parts of Baystal P 7110 as a binder, calculated as dry substance (styrene/butadiene latex from Polymerlatex GmbH)

1 part of polyvinyl alcohol as a synthetic co-binder, calculated as dry substance 0.25 part of Polysalz® S as a dispersant (BASF AG)

Solids content: 65%, pH: 8.8.

The polyvinyl alcohol used was Polyviol LL 603 (Wacker-Chemie). This is a 20% strength aqueous solution of a polyvinyl alcohol having a degree of hydrolysis of 88% and a Brookfield viscosity of about 900 mPas at 20° C.

The coating slip was divided into 8 parts and the above-mentioned amounts of brightener preparations from Examples 2 and 3 are added to one part each.

The whiteness parameters of the papers obtained are shown in Tables 3 and 4.

TABLE 3

| Brightener preparation from Example 2 (E1/1 = 105) | | | | |
|---|---|---|---|---|
| Amount (%) | CIE whiteness | L* | a* | b* |
| 0.8 | 97.90 | 94.30 | 1.15 | −2.68 |
| 1.6 | 107.10 | 94.52 | 1.59 | −4.59 |
| 2.4 | 111.50 | 94.62 | 1.83 | −5.53 |
| 3.2 | 114.60 | 94.73 | 2.02 | −6.16 |

TABLE 4

| Brightener preparation from Example 3 (E1/1 = 105) | | | | |
|---|---|---|---|---|
| Amount (%) | CIE whiteness | L* | a* | b* |
| 0.8 | 98.70 | 94.41 | 1.13 | −2.79 |
| 1.6 | 104.50 | 94.55 | 1.27 | −4.00 |
| 2.4 | 107.00 | 94.61 | 1.31 | −4.52 |
| 3.2 | 109.70 | 94.73 | 1.42 | −5.07 |

It can be seen that the brightener preparation according to the invention from Example 2 in the polyvinyl alcohol-containing coating slip showed substantially improved build-up behavior with respect to the CIE whiteness compared with the preparation from Example 3, which is not according to the invention.

Use Example 3

The procedure is as in use Example 1 was practiced, except that a polyvinyl alcohol-containing coating slip of another composition was employed and the brightener preparations from Example 1 were used in concentrations of 1%, 4.5% and 8%, based on the pigment content of the coating slip. The polyvinyl alcohol used was Polyviol® LL 603 (Wacker Chemie).

Composition of the coating slip:

100 parts of kaolin 24 parts of Acronal® S 320 D (BASF AG)

8 parts of polyvinyl alcohol, calculated as dry substance 0.3 part of Polysalz® s (BASF AG)

0.1 part of NaOH

Water

The water content was chosen so that a solids content of 50% results. The coating slip was divided into 3 parts and the above-mentioned amounts of the brightener preparation from Example 1 were added to one part each.

The whiteness parameters of the papers obtained are shown in Table 5.

Use Example 4

The procedure is as in use Example 3 was practiced, but, instead of 8 parts of polyvinyl alcohol, 8 parts of carboxymethylcellulose Finnfix® 10 (Noviant) were used.

The whiteness parameters of the papers obtained are shown in Table 5.

Comparative Example (Analogous to Example C 1 of EP 192 600):

1 part, 4.5 parts and 8 parts (based on pigment) of the brightener preparation from Example 1 are incorporated into an aqueous coating slip. The coating slip had the following composition:

100 parts of kaolin 24 parts of Acronal® S 320 (BASF AG)

8 parts of starch, calculated as dry substance 0.3 part of Polysalz® S (BASF AG)

0.1 part of NaOH

Water

The water content was chosen so that a solids content of 50% results.

Papers were finished with the coating slips thus obtained, according to the procedure described in Example 1, and their whiteness parameters were determined. The results are shown in Table 5.

TABLE 5

| Brightener preparation from Example 1 (E1/1 = 125) | | | | |
|---|---|---|---|---|
| Amount (%, based on pigment) | CIE whiteness | L* | a* | b* |
| Use Example 3 (polyvinyl alcohol-containing coating slip): | | | | |
| 1.0 | 106.10 | 94.10 | 1.29 | −4.53 |
| 4.5 | 117.0 | 94.35 | 1.85 | −6.81 |
| 8.0 | 120.6 | 94.43 | 1.97 | −7.59 |
| Use Example 4 (CMC-containing coating slip): | | | | |
| 1.0 | 101.7 | 93.98 | 0.85 | −3.60 |
| 4.5 | 109.2 | 94.16 | 1.17 | −5.17 |
| 8.0 | 114.6 | 94.23 | 1.26 | −6.34 |
| Comparative Example (starch-containing coating slip): | | | | |
| 1.0 | 98.3 | 93.93 | 0.67 | −2.89 |
| 4.5 | 103.8 | 94.18 | 0.71 | −3.98 |
| 8.0 | 107.4 | 94.45 | 0.38 | −4.63 |

It can be seen that the brightener preparation from Example 1 in a coating slip which contains polyvinyl alcohol or carboxymethylcellulose as a co-binder leads to substantially higher whiteness values than in a starch-containing coating slip having the same co-binder content.

Although the invention has been described in detail in the foregoing for the purpose of illustration, it is to be understood that such detail is solely for that purpose and that variations can be made therein by those skilled in the art without departing from the spirit and scope of the invention except as it may be limited by the claims.

What is claimed is:

1. A method for brightening an aqueous coating slip comprising a latex binder and at least one synthetic co-binder differing from the latex binder, comprising treating the aqueous coating slip with an optical brightener composition comprising an optical brightener consisting of at least one optical brightener of the formula (IIa):

(IIa)

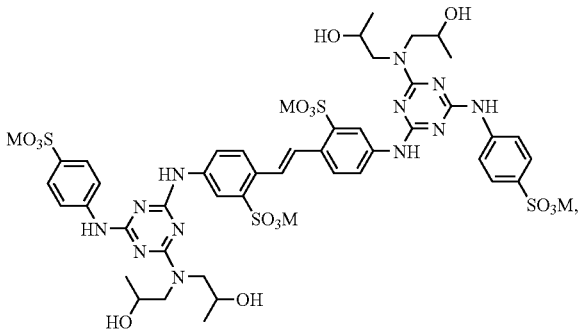

wherein

M denotes H or one equivalent of a cation selected from the group consisting of Li, Na, K, Ca, Mg, ammonium and ammonium which is mono-, di-, tri- or tetrasubstituted by the radicals $C_1$-$C_4$-alkyl or $C_2$-$C_4$-hydroxyalkyl, -and water, wherein the optical brightener composition is carrier-free:

wherein the at least one latex binder consists of a latex binder based on styrene/butadiene, a latex binder based on styrene/acrylate, or a latex binder based on vinyl acetate;

wherein the at least one synthetic co-binder consists of carboxymethylcellulose, hydroxyalkylcellulose, polyvinyl alcohol, synthetic acrylate-based thickener, or a combination thereof; and wherein the aqueous coating slips exhibits improved brightening as compared to a coating slip containing (i) at least one latex binder and (ii) a natural binder.

2. The method of claim 1, wherein the latex binder is a latex based on styrene/butadiene.

3. The method of claim 1, wherein the synthetic co-binder is selected from the group consisting of carboxymethylcellulose, polyvinyl alcohol, and combinations thereof.

4. The method of claim 1, wherein at least one latex binder based on styrene/butadiene is used as the latex binder and carboxymethylcellulose and/or polyvinyl alcohol is used as the synthetic co-binder.

5. The method of claim 1, wherein the coating slip contains at least one white pigment.

6. The method of claim 1, wherein the coating slip contains the latex binder in an amount of from about 3 to about 20% by weight and the co-binder in an amount of from about 0.1 to about 3% by weight, based in each case on the amount of white pigment.

7. The method of claim 1, wherein the latex binder is in an amount ranging from about 5 to about 15% by weight, and the co-binder is in an amount ranging from about 0.5 to about 1.5% by weight, based on the amount of white pigment.

8. A coating slip comprising:

(a) at least one white pigment, (b) at least one latex binder consisting of a latex binder based on styrene/butadiene, a latex binder based on styrene/acrylate, or a latex binder based on vinyl acetate, (c) at least one synthetic co-binder differing therefrom, consisting of carboxymethylcellulose, hydroxyalkylcellulose, polyvinyl alcohol, synthetic acrylate-based thickener, or a combination thereof; and (d) an optical brightener composition comprising an optical brightener consisting of at least one brightener of the formula (IIa):

(IIa)

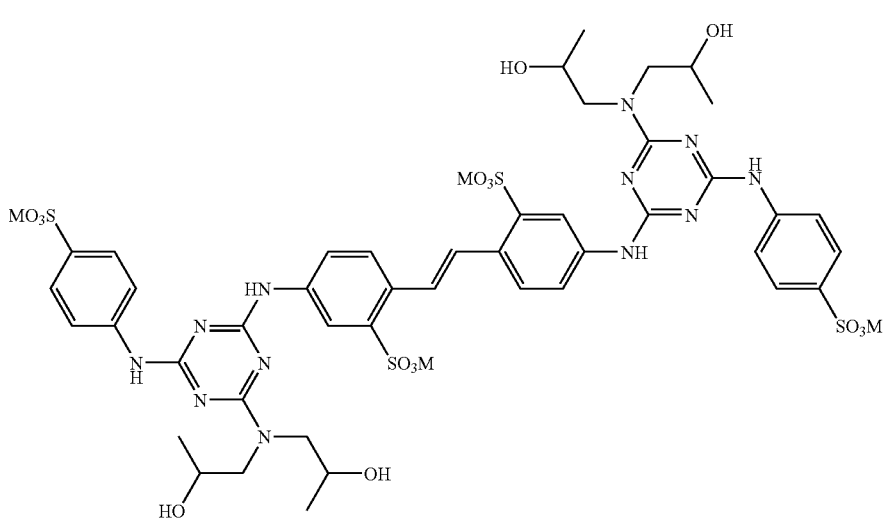

wherein

M denotes H or one equivalent of a cation selected from the group consisting of Li, Na, K, Ca, Mg, ammonium and ammonium which is mono-, di-, tri- or tetrasubstituted by the radicals $C_1$-$C_4$-alkyl or $C_2$-$C_4$-hydroxyalkyl, and water, wherein the optical brightener composition is carrier-free.

9. The coating slip according to claim 8, wherein the slip comprises:

(a) from 3 to 20% by weight of the latex binder;

(b) from 0.1 to 3% by weight of the co-binder;

(c) 0.025 to 1% by weight of the brightener of the formula (IIa), based in each case on the amount of white pigment.

10. The coating slip of claim 9, wherein the latex binder is in an amount ranging from about 5 to about 15% by weight, and the co-binder is in an amount ranging from about 0.5 to about 1.5% by weight, based on the amount of white pigment.

11. A method for making a coated paper comprising applying to a paper substrate a coating slip comprising:

(a) at least one white pigment, (b) at least one latex binder consisting of a latex binder based on styrene/butadiene, a latex binder based on styrene/acrylate or a latex binder based on vinyl acetate, (c) at least one synthetic co-binder differing therefrom, consisting of carboxymethylcellulose, hydroxyalkylcellulose, polyvinyl alcohol, synthetic acrylate-based thickener, or a combination thereof, and (d) an optical brightener composition comprising an optical brightener consisting of at least one brightener of the formula (IIa):

(IIa)

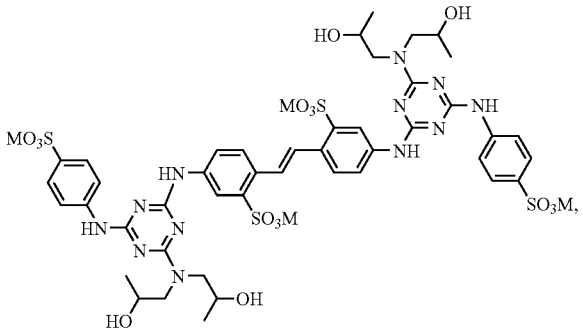

wherein

M denotes H or one equivalent of a cation selected from the group consisting of Li, Na, K, Ca, Mg, ammonium and ammonium which is mono-, di-, tri- or tetrasubstituted by the radicals $C_1$-$C_4$-alkyl or $C_2$-$C_4$-hydroxyalkyl, and water, wherein the optical brightener composition is carrier-free.

12. The method of claim 11, wherein the coating slip comprises from about 3 to about 20% by weight, of the latex binder; from 0.1 to 3% by weight, of the co-binder; 0.025 to 1% by weight of the brightener of formula (IIa), based in each case on the amount of white pigment.

13. The method of claim 11, wherein the latex binder is in an amount ranging from about 5 to about 15% by weight, and the co-binder is in an amount ranging from about 0.5 to about 1.5%.

14. A coated paper made from the method of claim 11.

15. The method of claim 1, wherein the coating slip further comprises a dispersant based on poly(acrylic acid).

16. The coating slip of claim 8, further comprising a dispersant based on poly(acrylic acid).

17. The method of claim 11, wherein the coating slip further comprises a dispersant based on poly(acrylic acid).

18. A coating slip comprising:

at least one white pigment;

a binder consisting of a latex binder based on styrene/butadiene, a latex binder based on styrene/acrylate, or a latex binder based on vinyl acetate, and a synthetic co-binder consisting of carboxymethylcellulose, hydroxyalkylcellulose, polyvinyl alcohol, synthetic acrylate-based thickener, or a combination thereof; and an optical brightener composition comprising an optical brightener consisting of at least one optical brightener of the formula (IIa)

(IIa)

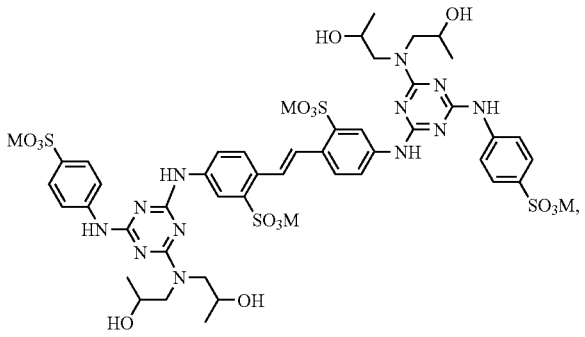

wherein M is Na, and water;

wherein the optical brightener composition is carrier-free.

19. The coating slip of claim 18, further comprising a dispersant based on poly(acrylic acid).

* * * * *